US010663887B2

(12) United States Patent
Kobayashi et al.

(10) Patent No.: US 10,663,887 B2
(45) Date of Patent: May 26, 2020

(54) CARTRIDGE SUPPORT UNIT

(71) Applicant: FUJI XEROX CO., LTD., Tokyo (JP)

(72) Inventors: Akihiro Kobayashi, Kanagawa (JP); Yuzo Mochida, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/352,794

(22) Filed: Mar. 13, 2019

(65) Prior Publication Data

US 2020/0096905 A1 Mar. 26, 2020

(30) Foreign Application Priority Data

Sep. 25, 2018 (JP) ..... 2018-178556

(51) Int. Cl.
*G03G 15/08* (2006.01)

(52) U.S. Cl.
CPC ..... *G03G 15/0886* (2013.01); *G03G 15/0867* (2013.01)

(58) Field of Classification Search
CPC ..... G03G 15/0886
See application file for complete search history.

(56) References Cited

U.S. PATENT DOCUMENTS 7,738,818 B2 * 6/2010 Murakami ..... G03G 15/0872 399/258

FOREIGN PATENT DOCUMENTS

JP 2005-37673 2/2005

* cited by examiner

*Primary Examiner* — David M. Gray
*Assistant Examiner* — Andrew V Do
(74) *Attorney, Agent, or Firm* — JCIPRNET

(57) ABSTRACT

A cartridge support unit includes a housing, a toner cartridge, a guide member, a shutter body, and at least one snap fit portion. The housing has an opening. The toner cartridge has a cylindrical shape, has an outer circumferential surface, and is removably mounted in the housing. The guide member has portions and is provided at such a position in the housing that the opening is interposed between the portions of the guide member. The shutter body slides against the guide member from a closed position where the shutter body covers the opening to an open position where the shutter body exposes the opening. The at least one snap fit portion extends from the shutter body and has a protrusion. The protrusion is pushed by the outer circumferential surface of the toner cartridge so as release a lock state at the closed position.

21 Claims, 8 Drawing Sheets

CARTRIDGE SUPPORT UNIT

CROSS-REFERENCE TO RELATED APPLICATIONS

This application is based on and claims priority under 35 USC 119 from Japanese Patent Application No. 2018-178556 filed Sep. 25, 2018.

BACKGROUND

(i) Technical Field

The present disclosure relates to a cartridge support unit.

(ii) Related Art

As a method of replenishing a developing device with new toner, toner cartridge is used. The toner cartridge is easily handled and allows the developing device to be easily replenished with the toner while suppressing dispersion of the toner to a region around the toner cartridge. When the toner cartridge is mounted and a toner cartridge body is rotated, a transport exit formed in the toner cartridge body is moved out from a retracting portion into which the transport exit has been retracted and which has closed the transport exit. The transport exit is then moved onto a transport entrance of a toner transport mechanism, which transports the toner to the developing device, so as to align the transport entrance and the transport exit with each other. Furthermore, this transport entrance of the toner transport mechanism is provided with a shutter that opens/closes the transport entrance. This shutter is closed when the toner cartridge is not mounted. When the toner cartridge is mounted, an engagement portion provided in the toner cartridge body is engaged with an engagement receiving portion provided in the shutter. When the toner cartridge body is rotated in this state, the shutter is opened (for example, Japanese Unexamined Patent Application Publication No. 2005-37673).

SUMMARY

Aspects of non-limiting embodiments of the present disclosure relate to providing of a device with which a shutter that opens/closes a transport entrance of a toner transport mechanism is not easily opened.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cartridge support unit including a housing, a toner cartridge, a guide member, a shutter body, and at least one snap fit portion. The housing has an opening. The toner cartridge has a cylindrical shape, has an outer circumferential surface, and is removably mounted in the housing. The guide member has portions and is provided at such a position in the housing that the opening is interposed between the portions of the guide member. The shutter body slides against the guide member from a closed position where the shutter body covers the opening to an open position where the shutter body exposes the opening. The at least one snap fit portion extends from the shutter body and has a protrusion. The protrusion is pushed by the outer circumferential surface of the toner cartridge so as to release a lock state at the closed position.

BRIEF DESCRIPTION OF THE DRAWINGS

Exemplary embodiment of the present disclosure will be described in detail based on the following figures, wherein.

DETAILED DESCRIPTION

Exemplary Embodiment

Figure 1:
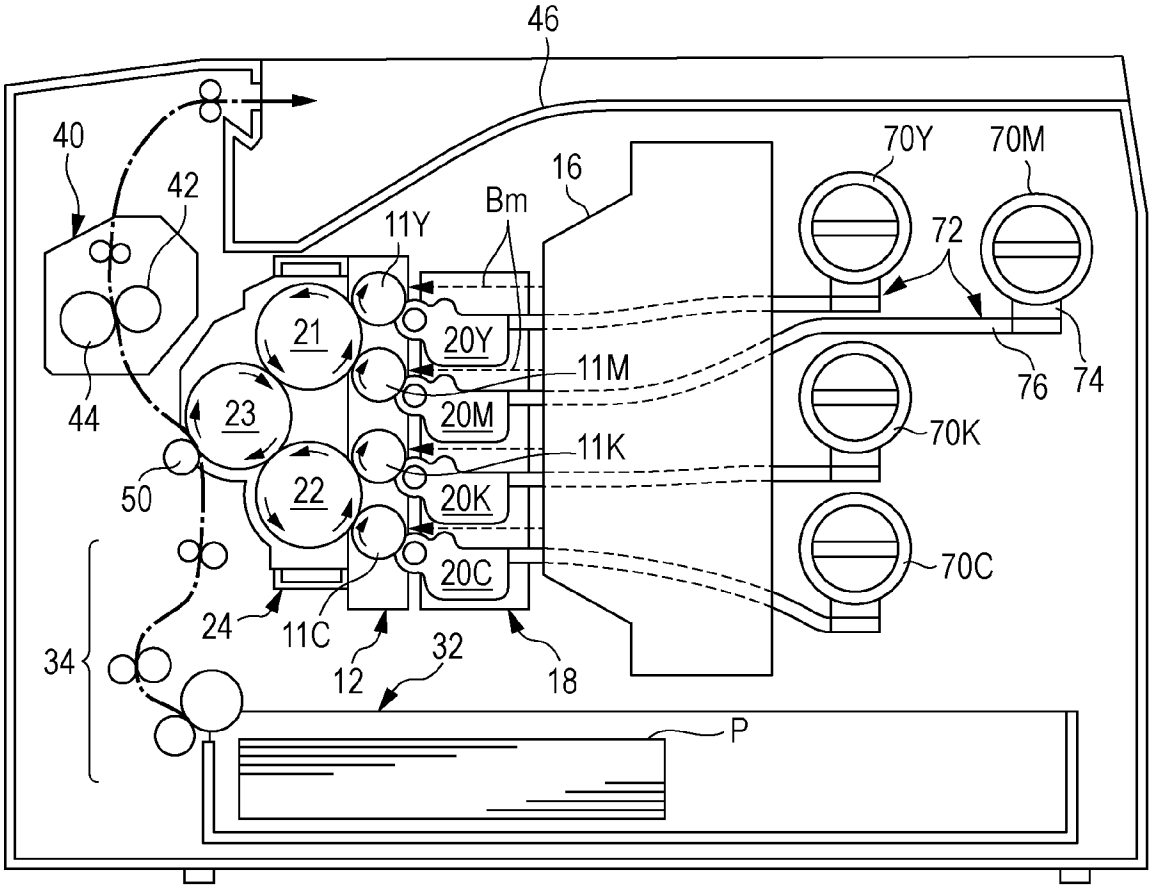
FIG. 1 is a schematic view of the structure of an image forming apparatus according to an exemplary embodiment.

FIG. 1 illustrates the structure of an image forming apparatus 10 according to an exemplary embodiment of the present disclosure. The image forming apparatus 10 is a so-called laser printer, which employs a known electrophotographic process to form images (toner images) in accordance with image information received from an external device and record the formed images in, for example, sheets of recording paper. The electrophotographic process refers to the following series of types of processing: charging of an electrophotographic receptor; forming of an electrostatic latent image through light exposure; developing of the electrostatic latent image with toner so as to form a toner image; transferring of the toner image on the electrophotographic receptor to a recording medium; and heat fixing of the transferred toner image so as to be recorded in the recording medium.

The image forming apparatus 10 is able to form color images with toner of magenta M, yellow Y, black K, and cyan C. Hereinafter, when distinctive description is made for a particular color, K, Y, M, or C is suffixed to a reference sign (for example, "developing device 20Y" and the like).

In the image forming apparatus 10, for example, the following elements are disposed in positional relationships as illustrated in FIG. 1: a developing unit 18 that includes developing devices 20; photoconductor drum unit 12 that includes photoconductor drums 11; an intermediate transfer drum unit 24 that includes first intermediate transfer drums 21, 22 and a second intermediate transfer drum 23; a sheet feed unit 32 in which the recording sheets P are stored; a recording sheet transport mechanism 34 that transports the recording sheets P, a transfer roller 50, a fixing unit 40, a sheet receiving portion 46, a light exposure unit 16; and a toner transport mechanisms 72 that transport the toner contained in toner cartridges 70 to the developing devices 20. Solid arrows indicate rotating directions of the elements. The toner cartridges 70 are removably mounted on respective cartridge support units 74.

Generally, printing of a full-color image is performed by the image forming apparatus 10 as follows. First, in the photoconductor drum unit 12, the four photoconductor drums 11 are uniformly charged by charging rollers (not illustrated), and then, laser beams Bm corresponding to the colors Y, M, K, C are separately radiated to the respective surfaces of the charged photoconductor drums 11 by the light exposure unit 16. Thus, the photoconductor drums 11 are exposed to and scanned by the respective laser beams Bm traveling through gaps in the developing unit 18. As a result, electrostatic latent images of the colors corresponding to input information are formed on the respective photoconductor drums 11.

Next, the electrostatic latent images on the photoconductor drums 11 are developed by the developing devices 20 of the developing unit 18 for the respective colors. Thus, toner images of the Y, M, K, C colors are formed.

Next, the toner images of the colors formed on the respective photoconductor drums 11 are electrostatically transferred to the first intermediate transfer drums 21, 22 through first transfer. Specifically, the magenta and yellow toner images formed on the photoconductor drums 11M and 11Y are sequentially transferred in this order to the first intermediate transfer drum 21 so as to be superposed on each other, and the cyan and black toner images formed on the photoconductor drums 11C and 11K are sequentially transferred in this order to the first intermediate transfer drum 22 so as to be superposed on each other. Thus, a multi-toner image including the magenta and yellow toner images is formed on the first intermediate transfer drum 21. Also, a multi-toner image including the cyan and black toner images is formed on the first intermediate transfer drum 22.

Next, the superposed toner images respectively formed on the first intermediate transfer drums 21, 22 are electrostatically transferred to the second intermediate transfer drum 23 through second transfer. Thus, the toner images on the first intermediate transfer drum 21 (M and Y from the bottom) and the toner images on the first intermediate transfer drum 22 (C and K from the bottom) are respectively transferred to the second intermediate transfer drum 23 in this order so as to form a multi-toner image in which the Y, M, K, C toner images are superposed in this order from below.

Meanwhile, corresponding to such formation of the toner images, the recording sheet P is fed from the sheet feed unit 32 toward the transfer roller 50 at predetermined timing by the recording sheet transport mechanism 34. The recording sheet P fed to the transfer roller 50 is held by the transfer roller 50 and the second intermediate transfer drum 23, and the multi-toner image on the second intermediate transfer drum 23 is electrostatically transferred to the recording sheet P.

Next, the recording sheet P onto which the multi-toner image has been transferred is fed to the fixing unit 40. The recording sheet P passes through a fixing nip between a heating roller 42 and a pressure roller 44 of the fixing unit 40 so as to be subjected to fixing processing through application of heat and pressure to the recording sheet P. Then, the recording sheet P is output to the sheet receiving portion 46.

Through performing the series of types of image forming processing as described above, a full-color image is formed on a single recording sheet P. A set of hardware elements used to perform the above described image forming processing are collectively referred to as an image forming section.

The developing devices 20 are, according to need, replenished by the respective toner transport mechanisms 72 with the toner from the respective toner cartridges 70Y, M, K, C containing the toner of the four colors. The toner cartridges 70 are removably mounted on the cartridge support units 74. When any of the toner cartridges 70 runs out of the toner, this toner cartridge 70 is able to be replaced with a new toner cartridge 70.

Figure 2:
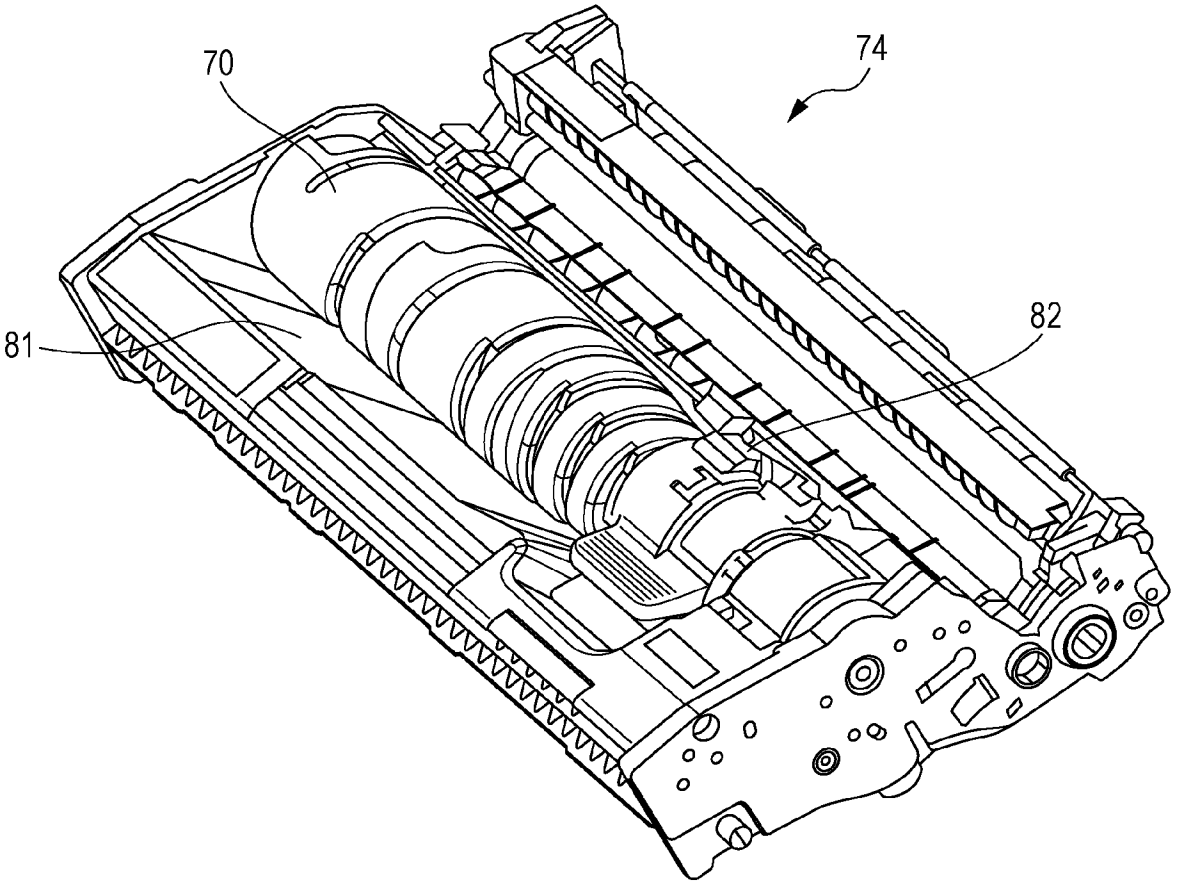
FIG. 2 illustrates the appearance of the structure of a cartridge support unit according to the exemplary embodiment.

FIG. 2 illustrates the appearance of one of the cartridge support units 74. Each of the cartridge support units 74 allows a corresponding one of the toner cartridges 70 to be removably mounted in a corresponding one of housings 81. The housings 81 are each provided with a corresponding one of shutter mechanisms 82. The toner cartridge 70 has a cylindrical shape and is rotated on the housing 81 of the cartridge support unit 74, thereby being secured to the housing 81. Here, the "cylindrical shape" refers to a shape in which at least part of an outer circumferential surface has a cylindrical shape, and the outer circumferential surface of the cylindrical shape may have projections, recesses, or the like.

Figure 3A:
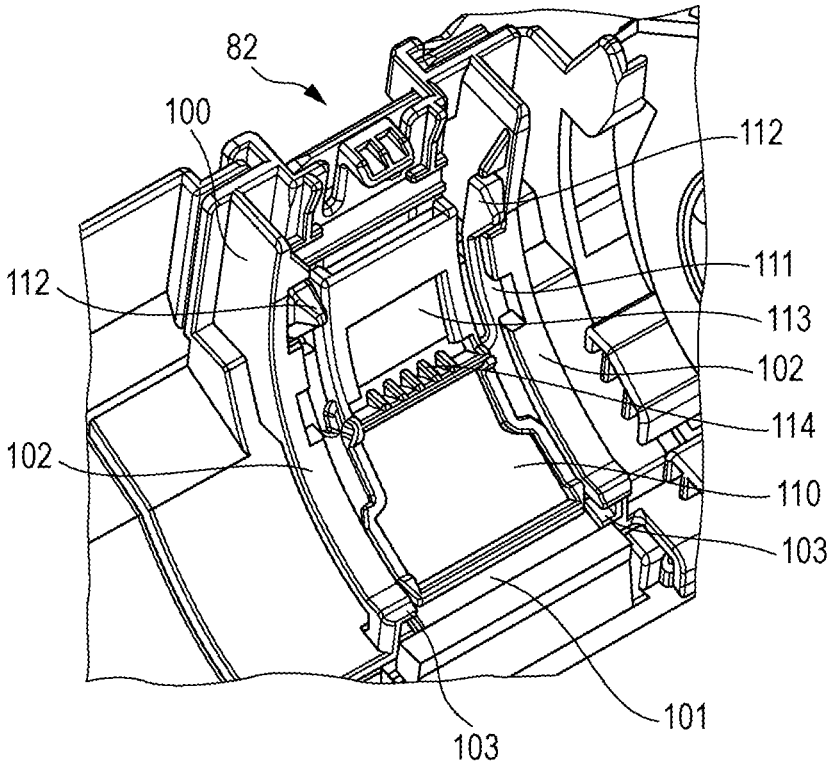
FIGS. 3A and 3B illustrate a shutter mechanism of the cartridge support unit according to the exemplary embodiment.
Figure 3B:
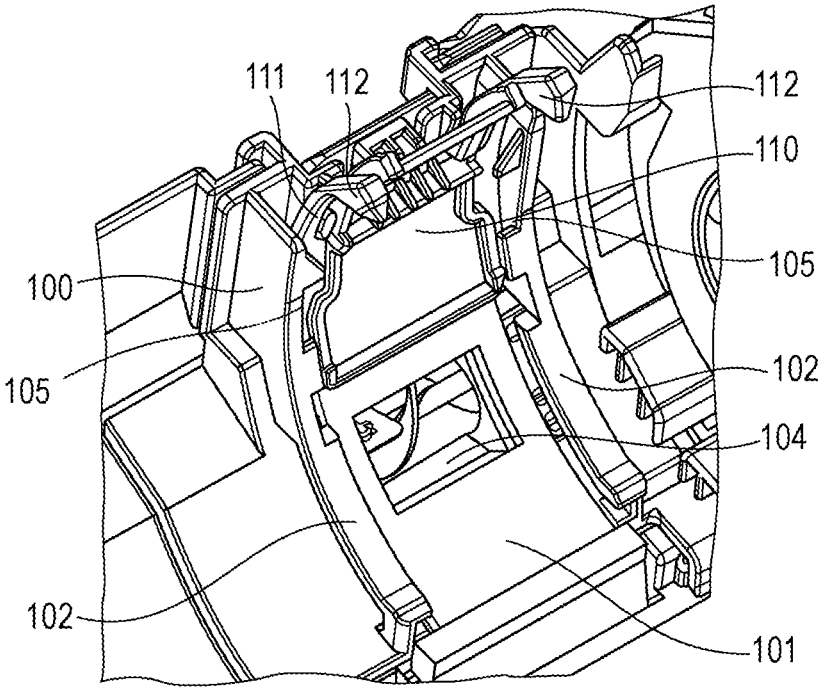

FIGS. 3A and 3B illustrate the structure of the shutter mechanism 82. The shutter mechanism 82 includes a guide member 100 and a shutter body 110. FIG. 3A illustrates the case where the shutter body 110 is at a closed position, and FIG. 3B illustrates the case where the shutter body 110 is at an open position. A sealing member 101 is attached to the surface of the guide member 100. The sealing member 101 is an elastic member formed of, for example, a sponge or the like. According to the present exemplary embodiment, in a state in which the toner cartridge 70 is mounted, a transport exit of the toner cartridge 70 communicates with a transport entrance of the housing 81 when the shutter body 110 is at the open position. Furthermore, the shutter body 110 at the closed position blocks the communication between the transport exit of the toner cartridge 70 and the transport entrance of the housing 81.

Grooves 103 are provided in side portions 102 on both sides of the guide member 100. The grooves 103 allow side portions of the shutter body 110 to be inserted thereinto and slide therealong. The grooves 103 each have a U shape as seen from the front in the direction in which the shutter body 110 is moved.

As illustrated in FIG. 3B, when the shutter body 110 has slid to the open position, a transport entrance 104 provided in the guide member 100 is exposed. The transport entrance 104 is provided at a position corresponding to the transport entrance provided in the housing 81. When the toner cartridge 70 is mounted, the toner transported to the outside through the transport exit provided in the toner cartridge 70 is transported to the inside through the transport entrance 104.

According to the present exemplary embodiment, "downstream" is in the direction in which the shutter body 110 is moved from the closed position illustrated in FIG. 3A to the open position illustrated in FIG. 3B, and "upstream" is in the opposite direction.

Recesses 105 are formed in downstream portions of the side portions 102 of the guide member 100. Two snap fit portions 111 are provided upstream of the shutter body 110. The snap fit portions 111 extend toward the upstream side from both the side portions of the shutter body 110. The snap fit portions 111 are integral with the shutter body 110. Protrusions 112 are provided at distal end portions of the snap fit portions 111. As illustrated in FIG. 3A, at the closed position, the protrusions 112 of the snap fit portions 111 are fitted into the respective recesses 105 of the guide member 100. Since the protrusions 112 and the recesses 105 are engaged with one another, even when the shutter body 110 is, for example, pushed by a user, it is unlikely that the shutter body 110 is moved downstream so as to exposed the transport entrance 104.

A downstream portion of the shutter body 110 is positioned between two snap fit portions 111 in the direction intersecting the direction in which the shutter body 110 is moved. The downstream portion has an opening 113 and a projecting portion 114. The structures of these will be described later.

The sealing member 101 attached to the guide member 100 does not entirely extend to a region corresponding to the rear surface of the shutter body 110 at the closed position. The sealing member 101 does not extend to regions corresponding to the rear surfaces of the entire snap fit portions 111 or at least the distal end portions of the snap fit portions 111 of the shutter body 110. The surface of the guide member 100 is exposed in the regions where the sealing member 101 is not attached.

Figure 4A:
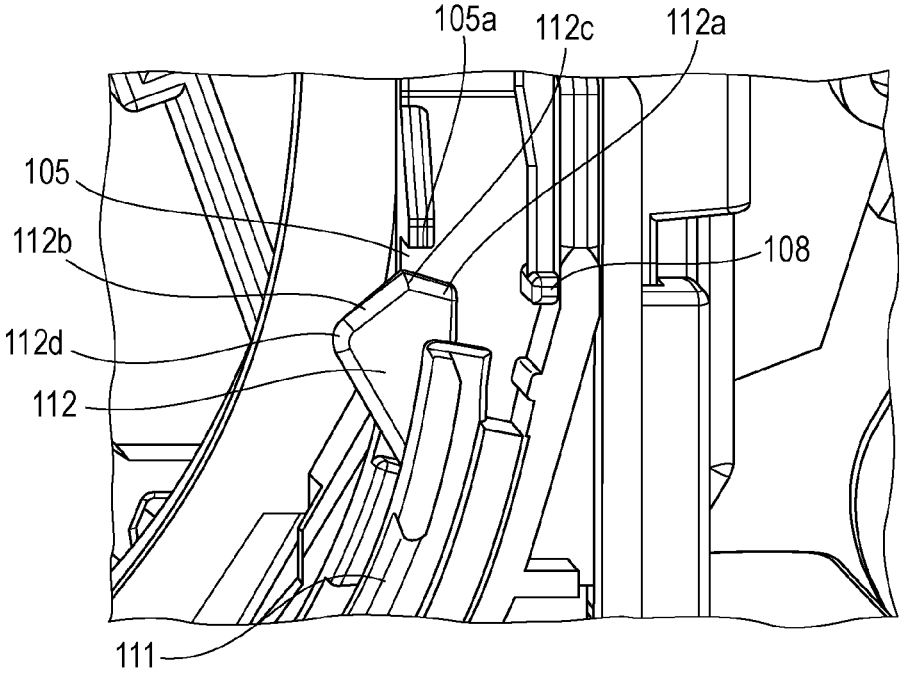
FIGS. 4A and 4B illustrate the relationship between a shutter body at a shutter closed position and a guide member according to the exemplary embodiment.
Figure 4B:
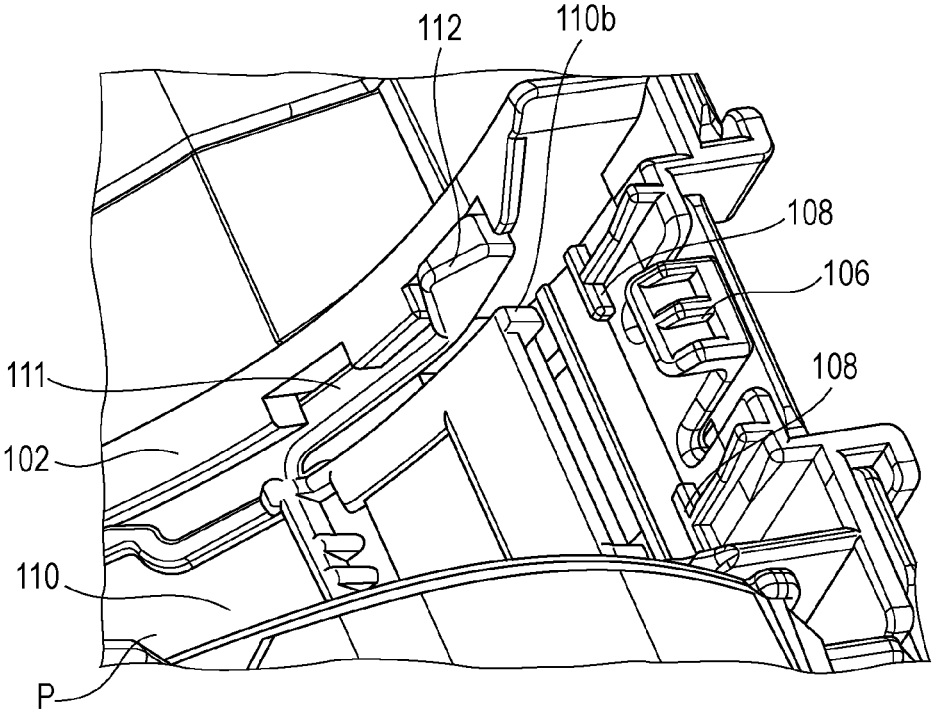

FIGS. 4A and 4B illustrate further details of the positional relationship between the shutter body 110 at the shutter closed position and the guide member 100. As illustrated in FIG. 4A, each of the protrusions 112 has a first flat surface 112*a* that faces a wall surface 105*a* of the guide member 100 when the shutter body 110 is at the closed position. The first flat surface 112*a* is inclined to a rear side of the protrusion 112 in a plane perpendicular to a line that is a rotation axis when the toner cartridge 70 is mounted. For example, it is assumed that, when the shutter body 110 is at the closed position, the user pushes a position P of the shutter body 110 (see FIG. 4B) with his or her finger so as to apply a force to move the shutter body 110 downstream. In this case, the shutter body 110 is pushed into the sealing member 101 direction. However, the snap fit portion 111 is not pushed in and the protrusion 112 remains engaged with the recess 105. Thus, even when the force is applied to move the shutter body 110 downstream in this state, the first flat surface 112*a* of the protrusion 112 is brought into contact with the wall surface 105*a*. At this time, since the first flat surface 112*a* is inclined toward the rear side, a force in the direction opposite to the rear side is applied to the protrusion 112, that is, a force in the direction projecting from the recess 105 is applied to the protrusion 112. Thus, the protrusion 112 does not move beyond the wall surface 105*a* so as to move out of the recess 105 to the downstream side.

As illustrated in FIG. 4A, each of the protrusions 112 has a second flat surface 112*b* that is an inclined surface forming a protruding shape. When the shutter body 110 is at the closed position, a position 112*c* where the first flat surface 112*a* and the second flat surface 112*b* intersect each other is on an apex position 112*d* of the protrusion 112 side of a rear end point of the wall surface 105*a*.

As illustrated in FIGS. 4A and 4B, two ribs 108 that regulate the movement of the shutter body 110 at the closed position are provided on the downstream portion of the guide member 100 behind the protrusions 112. Each of the ribs 108 exemplifies a "first projection". For example, it is assumed that the user pushes a region at or near the position P of the shutter body 110 with his or her finger so as to apply a force to move the shutter body 110 downstream while pushing the protrusion 112 with his or her finger. In this case, when the force is applied to move the shutter body 110 downstream while the protrusion 112 is excessively pushed, the first flat surface 112*a* of the protrusion 112 is brought into contact with the corresponding rib 108. Thus, it is possible to regulate the movement of the shutter body 110 toward the downstream side.

Even when the protrusion 112 of the snap fit portion 111 is pushed in, the shutter body 110 is not pushed in. The snap fit portion 111 is displaced independently of the shutter body 110 in the direction toward the center of rotation of the toner cartridge 70. Thus, it is sufficient that the rib 108 be provided on a path along which the snap fit portion 111 is moved downstream. It is not required that the rib 108 be provided over the entirety of the movement path of the shutter body 110.

Figure 5:
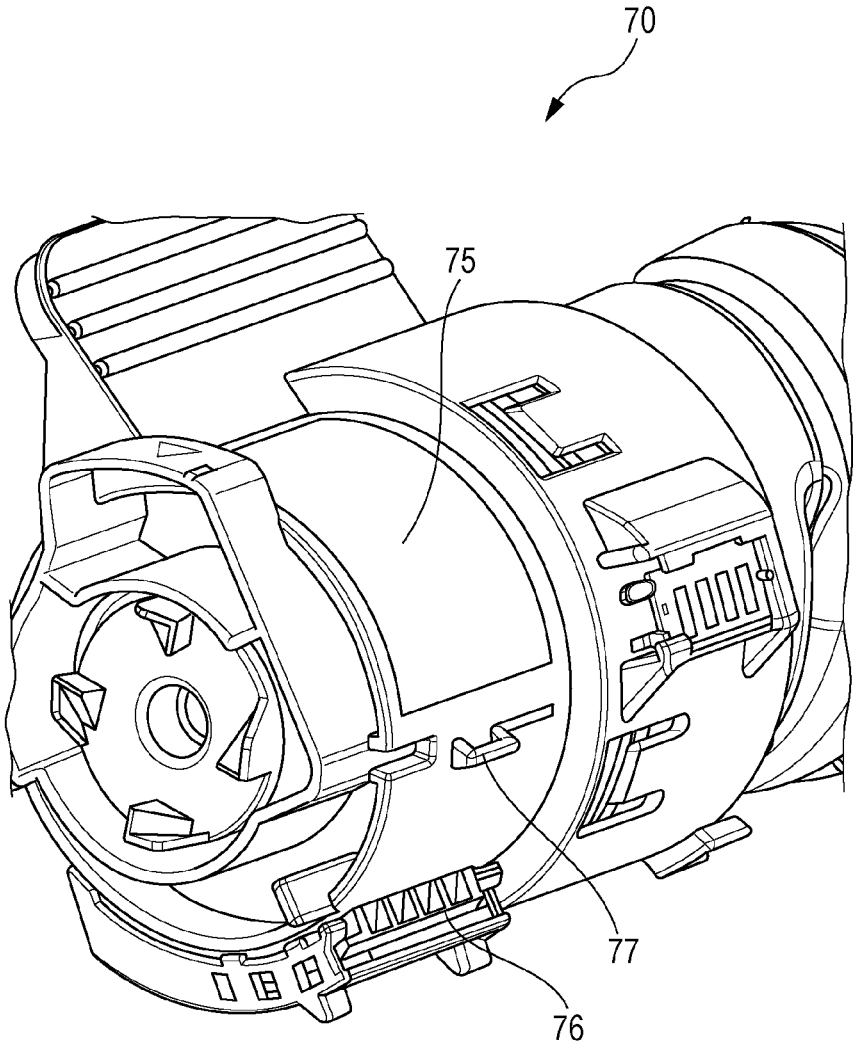
FIG. 5 illustrates the appearance of the structure of a toner cartridge according to the exemplary embodiment.

FIG. 5 illustrates the appearance of the toner cartridge 70. An outer circumferential surface 75 is pressed against the shutter body 110 when the toner cartridge 70 is mounted on the cartridge support unit 74. A projecting portion 76 and a projecting portion 77 project from the outer circumferential surface 75. When the toner cartridge 70 is mounted on the cartridge support unit 74 and rotated, the projecting portion 76 is brought into contact with an upstream end portion of the shutter body 110. This produces a force to move the shutter body 110 downstream.

The projecting portion 77 (exemplifying a "second projection") causes the shutter body 110 at the open position to move the closed position. When the toner cartridge 70 is mounted on the cartridge support unit 74, the projecting portion 77 enters the opening 113 of the shutter body 110. When the toner cartridge 70 is rotated upstream from the open position, the projecting portion 77 is brought into contact with a side in an upstream portion of the opening 113 of the shutter body 110. This produces a force to move the shutter body 110 upstream.

As described above, the toner cartridge 70 has two projecting portions 76 and 77 according to the present exemplary embodiment. The shutter body 110 is moved downstream by engaging the projecting portion 76 with the shutter body 110. The shutter body 110 is moved upstream by engaging the projecting portion 77 with the shutter body 110.

It is also possible to cause the shutter body 110 to move upstream and downstream with a single projecting portion of the toner cartridge 70. For example, as illustrated in FIG. 5 of Japanese Unexamined Patent Application Publication No. 2005-37673 described above, an engagement rib 162 that is a projection provided in a toner cartridge body 80 is inserted into an engagement receiving portion 182 provided on a downstream end portion of a shutter 180. The engagement rib 162 is engaged with the engagement receiving portion 182 when the toner cartridge body 80 is rotated downstream and the toner cartridge body 80 is rotated upstream. Thus, the shutter 180 is opened and closed with the engagement rib 162 that is a single projection.

However, with the structure of Japanese Unexamined Patent Application Publication No. 2005-37673 described above, the engagement rib is inserted in an ensured manner into the engagement receiving portion when the toner cartridge is mounted. This reduces a range of the directions in which the toner cartridge is caused to approach the shutter. To increase this range of directions, it is required to increase the length of the engagement receiving portion in the direction in which the shutter is moved. This may increase a space to be allocated for a shutter mechanism.

In contrast, according to the present exemplary embodiment, it is not required to provide a member such as an engagement receiving portion into which the projecting portion of the toner cartridge 70 is inserted at an upstream or downstream end of the shutter body 110. According to the present exemplary embodiment, the shutter body 110 is able to be moved downstream by contact of the projecting portion 76 with the upstream end of the shutter body 110. Furthermore, the shutter body 110 is able to be moved upstream by contact of the projecting portion 77 with the side in the upstream portion of the opening 113 of the shutter body 110.

Figure 6A:
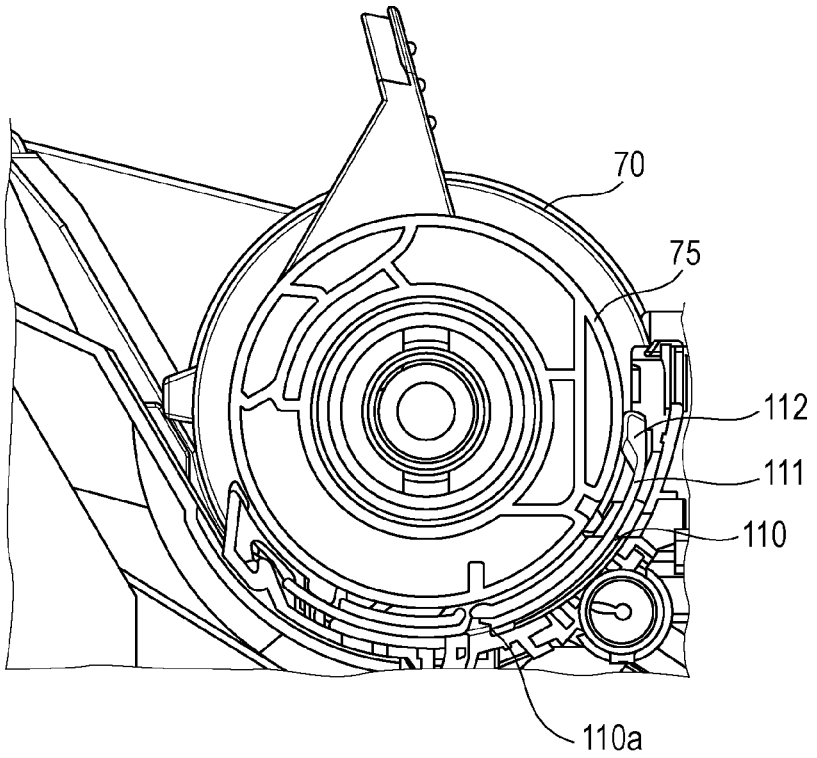
FIGS. 6A and 6B illustrate operations of the toner cartridge and the shutter body according to the exemplary embodiment.
Figure 6B:
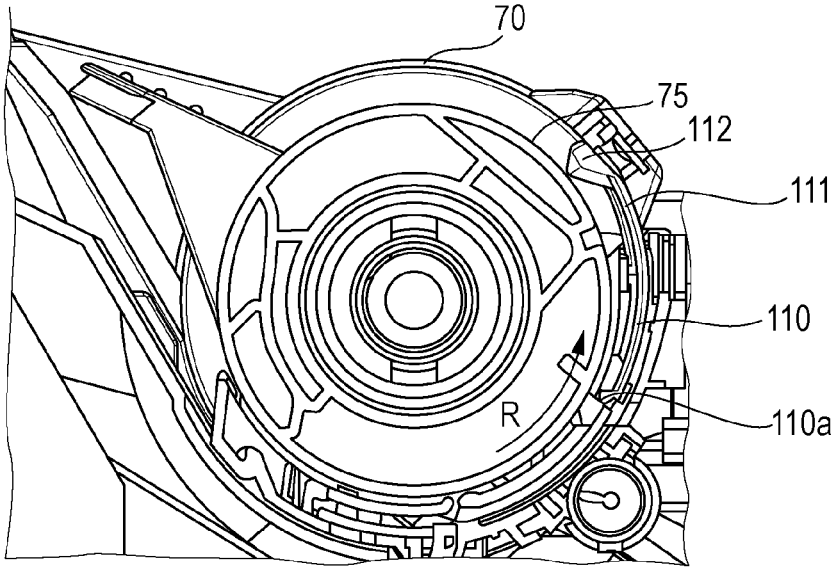
Figure 7:
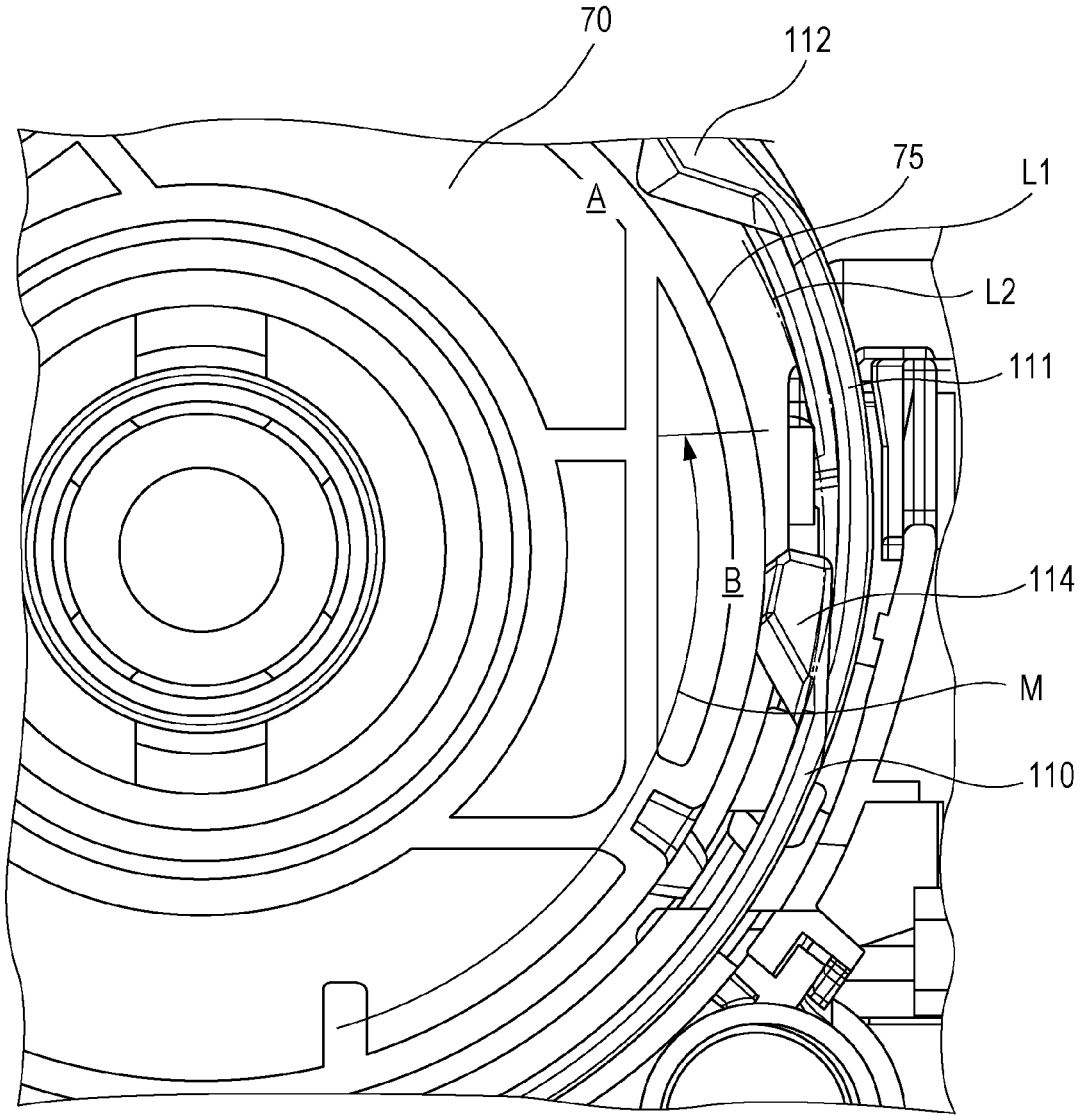
FIG. 7 illustrates the relationship between the toner cartridge and the shutter body at the shutter open position according to the exemplary embodiment.

FIGS. 6A and 6B illustrate operations of the toner cartridge 70 and the shutter body 110. Out of FIGS. 6A and 6B, FIG. 6A illustrates the closed position, and FIG. 6B illustrates the open position. FIG. 7 is an enlarged view of the shutter body 110 and a region around the shutter body 110 at the open position.

FIG. 6A illustrates the case where the toner cartridge 70 is mounted on the cartridge support unit 74, and the shutter body 110 is at the closed position. The protrusion 112 of the shutter body 110 protrudes upward from the recess 105 of the guide member 100 when the toner cartridge 70 is not mounted. When the toner cartridge 70 is mounted, the outer circumferential surface 75 of the toner cartridge 70 is brought into contact with the surface of the shutter body 110. The snap fit portion 111 is deformed to the rear side, and the protrusion 112 is pushed in by the outer circumferential surface 75 of the toner cartridge 70.

Referring back to FIGS. 4A and 4B, at the closed position, when the toner cartridge 70 is mounted and the protrusion 112 is pushed in by the outer circumferential surface 75 of the toner cartridge 70, the second flat surface 112*b* faces the wall surface 105*a*. The second flat surface 112*b* is inclined toward the outer circumferential surface 75 of the toner cartridge 70 in a plane perpendicular to a line that is the rotation axis when the toner cartridge 70 is mounted. When the toner cartridge 70 is mounted and the protrusion 112 is pushed in, rotating the toner cartridge 70 downstream brings the second flat surface 112*b* of the protrusion 112 into contact with the wall surface 105*a*. At this time, since the second flat surface 112*b* is inclined, a force toward the rear side is applied to the protrusion 112. Since the sealing member 101 is not provided behind the snap fit portion ill, the snap fit portion 111 deforms toward the rear side. When the toner cartridge 70 is rotated, the second flat surface 112*b* is moved downstream while being pressed against the wall surface 105*a* toward the rear side. Then, the second flat surface 112*b* is moved beyond the wall surface 105*a*, and the protrusion 112 is moved downstream.

In the state illustrated in FIG. 6A, the shutter body 110 is also brought into contact with the outer circumferential surface 75 of the toner cartridge 70. However, the shutter body 110 is not largely pushed toward the sealing member 101 provided behind the shutter body 110. As described above, the snap fit portions 111 are displaced independently of the shutter body 110 in the direction toward the center of rotation of the toner cartridge 70. Thus, in the state illustrated in FIG. 6A, the snap fit portions 111 have been displaced in the direction separating from the outer circumferential surface 75 of the toner cartridge 70 relative to the shutter body 110.

From the above description, in the state illustrated in FIG. 6A, when the toner cartridge 70 is rotated downstream, the projecting portion 76 of the toner cartridge 70 is brought into contact with an end portion 110*a* of the shutter body 110. This applies a force to move the shutter body 110 downstream. The shutter body 110 slides along the grooves 103 of the guide member 100 so as to be moved downstream. Since the protrusion 112 is pushed in by the outer circumferential surface 75 of the toner cartridge 70, the protrusion 112 is moved beyond the wall surface 105*a* of the recess 105 of the guide member 100. As a result, the shutter body 110 is moved downstream. The shutter body 110 is moved to a position illustrated in FIG. 6B. An arrow R illustrated in FIG. 6B indicates a rotating direction of the toner cartridge 70 (that is, the moving direction of the shutter body 110).

FIG. 7 illustrates the relationship between the toner cartridge 70 and the shutter body 110 at the open position. As illustrated in FIG. 7, at the open position, the protrusion 112 of the shutter body 110 is disposed at a position A. At the closed position, the protrusion 112 is disposed a position B. Also, the groove 103 of the guide member 100 is provided in a range indicated by an arrow M. A locus L1 indicated by a solid line is a locus of the movement of the protrusion 112 from the position B at the closed position to the position A at the open position. A locus L2 indicated by a broken line is an arcuate locus along the outer circumferential surface 75 of the toner cartridge 70.

The sectional shape of the groove 103 of the guide member 100 along which the shutter body 110 slides is an arcuate shape along the outer circumferential surface 75 of the toner cartridge 70. Accordingly, the shutter body 110 also has an arcuate sectional shape and is moved in the groove 103 of the guide member 100 along an arcuate locus as indicated by the locus L2. The snap fit portion 111 having the protrusion 112 also has an arcuate sectional shape. However, the snap fit portion 111 is moved beyond the arrow M range and moved out of the groove 103 when being moved to the open position. The protrusion 112 provided on the snap fit portion 111 is, when being moved downstream from the groove 103, moved along the locus L1 escaped from the outer circumferential surface 75 of the toner cartridge 70 compared to the arcuate locus L2.

During the movement toward the downstream side, since the protrusion 112 is pushed in, a force in the direction escaping from the toner cartridge 70 is applied to the snap fit portion 111 of the shutter body 110 so as to deform the snap fit portion 111. However, as the snap fit portion 111 is moved downstream, the snap fit portion 111 is moved out of the groove 103. Thus, the locus of the movement is along the locus L1 escaping from the outer circumferential surface 75 of the toner cartridge 70. This may suppress the deformation. After the shutter body 110 has been moved to the shutter open position, the protrusion 112 continues to be disposed at the position A. This may reduce the force applied to the snap fit portion 111, and accordingly, suppress the deformation when the toner cartridge 70 is mounted.

Although the protrusion 112 is pushed in by the toner cartridge 70, the protrusion 112 having been pushed in is positioned so as not to be brought into contact with the rib 108 illustrated in FIGS. 4A and 4B. Thus, while being moved downstream, the rear surface of the protrusion 112 is not brought into contact with the rib 108.

Figure 8:
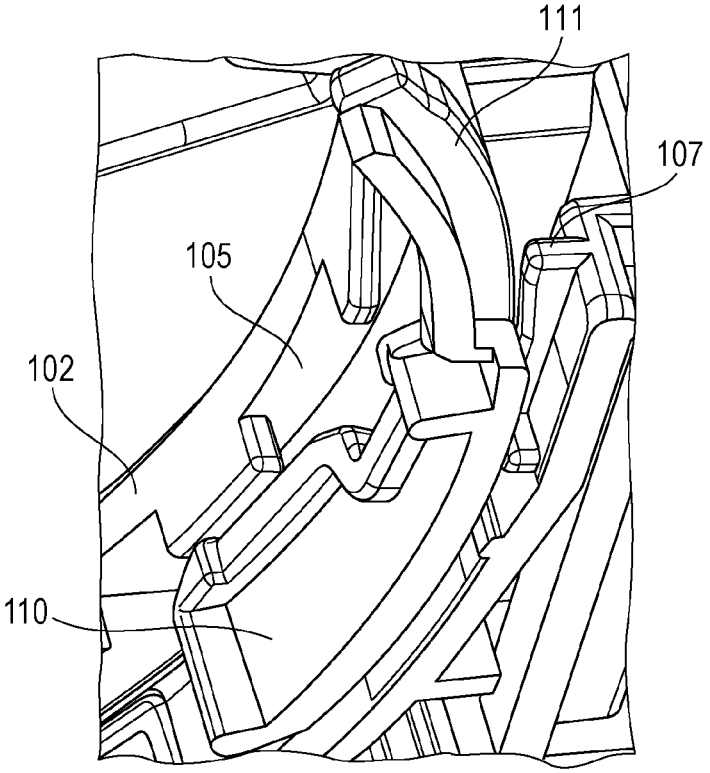
FIG. 8 illustrates a rib provided near a rear surface of the shutter body in the guide member according to the exemplary embodiment.

FIG. 8 illustrates a rib 107 provided behind the shutter body 110 in the guide member 100. As illustrated in FIG. 8, the rib 107, which is a projecting portion, is provided in the downstream portion of the guide member 100. The rib 107 is disposed near the rear surface of the shutter body 110 when the shutter body 110 is at the open position. The position of the rib 107 is not on the movement path of the snap fit portion 111. Although the rib 107 on one side of the guide member 100 and the shutter body 110 is illustrated in FIG. 8, another rib 107 is provided on the other side.

As described above, while the shutter body 110 is being moved downstream, the protrusion 112 is being moved in the locus along the locus L1 illustrated in FIG. 7 escaping from the outer circumferential surface 75 of the toner cartridge 70. At this time, portions of the shutter body 110 other than the protrusion 112 and the snap fit portion 111 are also moved in a locus escaping from the outer circumferential surface 75 of the toner cartridge 70. Hereinafter, the amount of this escaping is referred to as "escaping amount of the shutter body 110". The escaping amount of the shutter body 110 is smaller than an escaping amount of the protrusion 112. The details are, for example, as follows. When the shutter is closed, the protrusion 112 is pushed into (enters) the recess 105. A pushed-in amount of the protrusion 112 when the shutter is closed is represented as S1. From this state, when the protrusion 112 is moved in the direction in which the shutter is opened, the protrusion 112 escapes by an amount corresponding to the pushed-in amount. The escaping amount of the protrusion 112 at this time is represented as S2. At this time, the escaping amount of the shutter body 110 is smaller than the escaping amount S2 because of regulation by the guide member 100. Meanwhile, when the shutter has been completely opened, most of the shutter body 110 has been moved out of the guide member 100, and accordingly, the regulation by the guide member 100 is reduced. Furthermore, in this state, the sealing member 101 is scarcely provided behind the shutter body 110. Thus, when the shutter is completely opened, the escaping amount S2*p* of the shutter body 110 is substantially equal to the escaping amount S2 of the protrusion 112. That is, deformation of the shutter is substantially zero. When the shutter is deformed while the shutter is open, creep deformation may occur in the shutter. Furthermore, at this time, when the width of a space (space to which the shutter body 110 is able to escape) behind the shutter body 110 (largest escaping amount) is represented as S3, $S1 \approx S2 \approx S2p < S3$. Furthermore, when an amount of an accommodation gap of the cartridge is represented as S4, the cartridge is unable to accommodate when $S3 > S4$. Thus, the relationships $S2 < S3 < S4$ is required.

When the escaping amount of the shutter body 110 becomes excessively large, ease of contact between the projecting portion 77 of the toner cartridge 70 and the projecting portion 114 of the shutter body 110 is reduced when moving the shutter body 110 to the closed position. This may lead to the case where the shutter body 110 is not set at the closed position.

In order to address this, the rib 107 is provided behind the shutter body 110 according to the present exemplary embodiment. When the escaping amount of the shutter body 110 is large, the rib 107 is brought into contact with the rear surface of the shutter body 110 so as to suppress an increase in escaping amount. The rib 107 is not provided on the rear surface of the snap fit portion 111. Thus, the rib 107 does not affect the escaping amount of the protrusion 112.

The gap between the shutter body 110 and the rib 107 in the radial direction of the toner cartridge 70 is made to be smaller than the amount of engagement between the projecting portion 77 of the toner cartridge 70 and the projecting portion 114 of the shutter body 110 in the radial direction.

Referring to FIG. 8, the distance between the protrusion 112 and the guide member 100 in the radial direction behind the protrusion 112 is larger on the downstream side than on the upstream side of the guide member 100. That is, the gap behind the protrusion 112 is larger on the downstream side. Thus, when the shutter body 110 is moved upstream, pressing in or deformation of the snap fit portion 111 does not lead to contact of the snap fit portion 111 with the guide member 100 disposed behind the snap fit portion 111.

Figure 9:
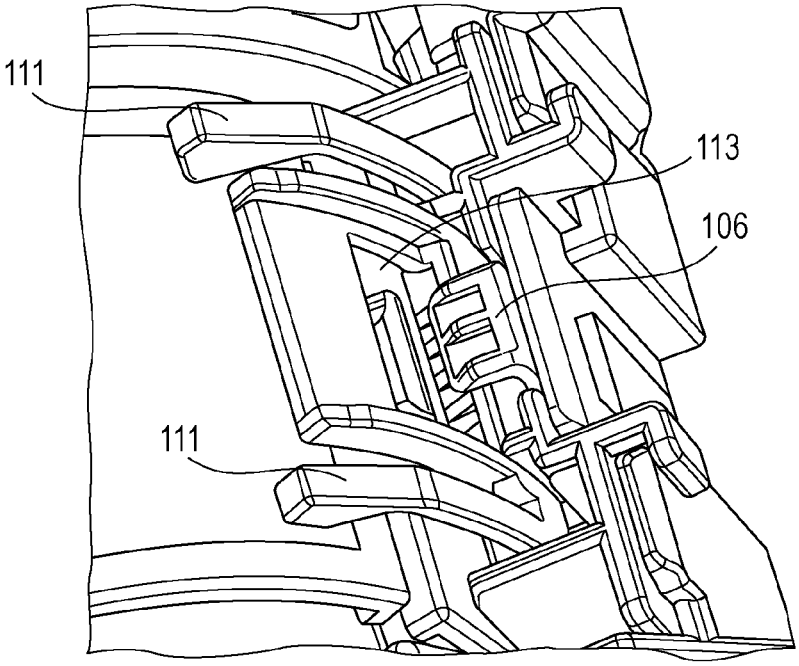
FIG. 9 illustrates a projecting portion that regulates a movement of the shutter body at the shutter open position in the guide member according to the exemplary embodiment.

FIG. 9 illustrates a projecting portion 106 that regulates the movement of the shutter body 110 at the open position in the guide member 100. As illustrated in FIG. 9, the projecting portion 106 is provided in the downstream portion of the guide member 100. When the toner cartridge 70 is mounted and the shutter body 110 is moved to the open position, the side in the upstream portion of the opening 113 of the shutter body 110 is moved to a position close to the projecting portion 106. The side in the upstream portion of the opening 113 may be brought into contact with the projecting portion 106.

With the projecting portion 106, when the toner cartridge 70 is mounted and set at the open position, the shutter body 110 is not necessarily moved out even in the case where the shutter body 110 is pulled downstream by the user.

Variations

The above-described exemplary embodiment is able to be varied in different manners. The variations are described as follows. The above-described exemplary embodiment and the variations described below may be appropriately combined.

1. According to the above-described exemplary embodiment, two snap fit portions 111 are provided in the shutter body 110. However, it may be sufficient that a single snap fit portion 111 be provided as long as the lock state is sufficiently maintained when the toner cartridge 70 is removed.

2. According to the above-described exemplary embodiment, the shutter body 110 has the opening 113. However, engagement with the projecting portion 77 is sufficiently provided, the shutter body 110 may have a recess that does not penetrate through the shutter body 110 instead of the opening 113, or the size of the opening may be reduced.

3. According to the above-described exemplary embodiment, the shutter body 110 has the opening 113. However, the amount of engagement between the projecting portion 114 and the projecting portion 77 of the toner cartridge 70 is sufficient, the opening 113 is not required. Furthermore, a portion between two snap fit portions 111 where the opening 113 is formed is not necessarily provided as long as problems with the strength or the movement for opening/closing do not arise.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cartridge support unit comprising:

a housing having an opening;

a cylindrical toner cartridge that has an outer circumferential surface and that is removably mounted in the housing:

a guide member that has portions and that is provided at such a position in the housing that the opening is interposed between the portions of the guide member;

a shutter body that slides against the guide member from a closed position where the shutter body covers the opening to an open position where the shutter body exposes the opening; and at least one snap fit portion that extends from the shutter body and that has a protrusion, wherein the protrusion is configured to be in a lock state with the guide member at the closed position, and the lock state at the closed position is released while the protrusion is pushed by the outer circumferential surface of the toner cartridge.

2. The cartridge support unit according to claim 1, wherein the guide member has two grooves disposed at such positions that the opening is interposed between the two grooves.

3. The cartridge support unit according to claim 2, wherein the at least one snap fit portion comprises a plurality of snap fit portions, and wherein the plurality of snap fit portions are provided at such positions that the plurality of snap fit portions each slide along a corresponding one of the two grooves.

4. The cartridge support unit according to claim 2, wherein the at least one snap fit portion comprises a plurality of snap fit portions, wherein the two grooves have respective recesses, and wherein the recesses are engaged with the respective protrusions when the shutter body is at the closed position.

5. The cartridge support unit according to claim 4, wherein the recesses have respective wall surfaces, and wherein the plurality of snap fit portions have respective first flat surfaces that face the wall surfaces of the respective recesses.

6. The cartridge support unit according to claim 5, wherein, in a section perpendicular to an axial direction of the toner cartridge, each of the first flat surfaces is inclined to a rear side of a corresponding one of the protrusions relative to a corresponding one of the wall surfaces.

7. The cartridge support unit according to claim 5, wherein the protrusions have respective second flat surfaces to be brought into contact with the respective recesses.

8. The cartridge support unit according to claim 7, wherein, in a section perpendicular to an axial direction of the toner cartridge, each of the first flat surfaces and a corresponding one of the second flat surfaces intersect each other at a position on a corresponding one of the protrusions side of a rear end point of a corresponding one of the wall surfaces.

9. The cartridge support unit according to claim 1, wherein the at least one snap fit portion is disposed downstream of the shutter body in a direction from the closed position toward the open position.

10. The cartridge support unit according to claim 9, wherein, when the shutter body is at the open position, the at least one snap fit portion is moved out of the guide member.

11. The cartridge support unit according to claim 10, wherein, in a section perpendicular to an axial direction of the toner cartridge, the guide member has a downstream portion in the direction from the closed position to the open position, and wherein at least part of the downstream portion of the guide member has an arcuate shape.

12. The cartridge support unit according to claim 9, wherein a gap on a rear side of the protrusion is larger on a downstream side than on an upstream side in the direction from the closed position toward the open position.

13. The cartridge support unit according to claim 12, wherein the guide member includes two ribs that define the gap.

14. The cartridge support unit according to claim 1, wherein the guide member includes a rib to be brought into contact with the shutter body when the shutter body is at the closed position.

15. The cartridge support unit according to claim 1, wherein the shutter body has an end portion, and wherein the guide member includes a first projection that regulates a movement of the end portion of the shutter body when the shutter body is at the open position.

16. The cartridge support unit according to claim 1, further comprising:

a sealing member provided on a surface of the guide member near the shutter body, wherein, when the shutter body is moved, the guide member is exposed in a path through which the at least one snap fit portion passes.

17. The cartridge support unit according to claim 1, wherein the toner cartridge includes a second projection at the outer circumferential surface, and wherein, when the toner cartridge is rotated, the second projection causes the shutter body to be moved in a direction toward the open position or a direction toward the closed position.

18. The cartridge support unit according to claim 17, wherein the shutter body has a downstream portion in a direction from the closed position toward the open position, and wherein a hole or a recess engaged with the second projection is provided on the downstream portion of the shutter body.

19. The cartridge support unit according to claim 1, wherein the at least one snap fit portion comprises a plurality of snap fit portions, and wherein at least part of the shutter body is positioned between the plurality of snap fit portions in a direction intersecting a direction in which the shutter body is moved.

20. A cartridge support unit comprising:

a housing having an opening;

a cylindrical toner cartridge that has an outer circumferential surface and that is removably mounted in the housing:

a guide member that has portions and that is provided at such a position in the housing that the opening is interposed between the portions of the guide member;

a shutter body that slides against the guide member from a closed position where the shutter body covers the opening to an open position where the shutter body exposes the opening; and a snap fit portion that extends from the shutter body, that has a protrusion in contact with the outer circumferential surface of the toner cartridge, and that is displaced independently of the shutter body in a direction toward a center of rotation of the toner cartridge.

21. A cartridge support unit comprising:

a housing having an opening;

a cylindrical toner cartridge that has an outer circumferential surface and that is removably mounted in the housing:

a guide member that has portions and that is provided at such a position in the housing that the opening is interposed between the portions of the guide member;

a shutter body that slides against the guide member from a closed position where the shutter body covers the opening to an open position where the shutter body exposes the opening; and at least one snap fit portion that extends from the shutter body and that has a protrusion which is pushed by the outer circumferential surface of the toner cartridge so as to release a lock state at the closed position, wherein the at least one snap fit portion is disposed downstream of the shutter body in a direction from the closed position toward the open position, and wherein, when the shutter body is at the open position, the at least one snap fit portion is moved out of the guide member.

* * * * *